United States Patent [19]

O'Leary

[11] Patent Number: 4,842,001

[45] Date of Patent: Jun. 27, 1989

[54] INDUSTRIAL WASHING MACHINE

[76] Inventor: James O'Leary, 117 Union Avenue, Komoka, Ontario, Canada, N0L 1R0

[21] Appl. No.: 922,292

[22] Filed: Oct. 23, 1986

[51] Int. Cl.[4] ..... B08B 3/00

[52] U.S. Cl. ..... 134/112; 134/138; 134/151; 134/199

[58] Field of Search ..... 134/138, 112, 198, 199, 134/151, 147, 148

[56] References Cited

U.S. PATENT DOCUMENTS

| | | | |
|---|---|---|---|
| 3,422,826 | 1/1969 | Ballard | 134/112 |
| 3,452,763 | 7/1969 | Ballard | 134/112 |
| 3,656,491 | 4/1972 | Ballard | 134/112 |
| 4,543,182 | 9/1985 | Gramse et al. | 134/111 |

FOREIGN PATENT DOCUMENTS

| | | | |
|---|---|---|---|
| 293336 | 2/1968 | Australia | 134/138 |

*Primary Examiner*—Renee S. Luebke

[57] ABSTRACT

The present invention provides an industrial washing machine in which articles or parts to be cleaned are supported in a basket rotated by a jet spray and cleaned by a cleaning spray, maintained at a desired pressure. The jet spray provides an overflow relief to avoid unacceptable increases in the cleaning spray pressure with the rotating basket being provided with a brake to substantially maintain a predetermined rotational speed of the basket.

21 Claims, 5 Drawing Sheets

53
31
57
39
35
37
65
15
67
45
51
69
63
44
55
42
59
46
61
47
62
43

INDUSTRIAL WASHING MACHINE

FIELD OF THE INVENTION

The present invention relates to an industrial washing machine having a rotating parts basket and an internal liquid reservoir from which cleaning liquid is pumped at the rotating basket for cleaning the parts. The same pump, which provides the cleaninq spray, is also used to provide a jet stream to rotate the parts basket.

BACKGROUND OF THE INVENTION

There is presently a need for an efficient industrial washing machine capable of effectively and thoroughly cleaning many different types of industrial products. This need is particularly felt in the automotive industry for the cleaning of automotive parts, such as transmissions and the like.

Attempts have been made in the past to produce automotive parts cleaning machines, however, these machines are subject to different mechanical problems, such as pump failure because the pumps are generally operated at relatively high pressures and subject to pressure variances caused as a result of spray line blockage problems and the like. In addition, these prior art machines generally use relatively sophisticated drive and brake assemblies for controlling basket speed rotation which can, again, be subject to different maintenance problems.

The existing industrial washing machines have only met with limited commercial success because they are often ineffective from a cleaning standpoint. One of the primary reasons for this problem is the recycling of relatively unclean washing solution onto the articles in the machine.

Over the last few years there has been a very strong move to improving the safety of industrial equipment in general, and therefore like many other fields there is a need for an advance in the state of the art with respect to the safety of industrial washing machinery.

SUMMARY OF THE PRESENT INVENTION

The present invention provides an industrial washing machine designed to operate in an extremely efficient manner using unique, yet relatively simple, components for mitigating maintenance requirements to the machine. In addition, the machine includes numerous different safety features for avoiding potential injuries to the machine operator.

More particularly, the industrial washing machine of the present invention comprises a housing, a liquid reservoir, and a rotatable article or parts receiving basket above the reservoir in the housing, braking means extending down flom the basket into the reservoir for braking rotational speed of the basket, spray means for producing a cleaning spray directed at articles in the basket and jet means directing a liquid stream for rotating the basket at a predetermined speed. In addition, the jet means provides an overflow relief, if required, from the spray means and increases accordingly in flow rate when providing such relief. However, the braking means substantially maintains the predetermined speed of the basket with any such increased flow rate from the jet means.

Through the cooperative action of the spray means and the jet means, the spray means can be set to a preset spray pressure and the jet means by providing the overflow relief, deters any substantial increases from that preset spray pressure.

BRIEF DISCUSSION OF THE DRAWINGS

DETAILED DESCRIPTION ACCORDING TO THE PREFERRED EMBODIMENTS OF THE PRESENT INVENTION

Figure 1:
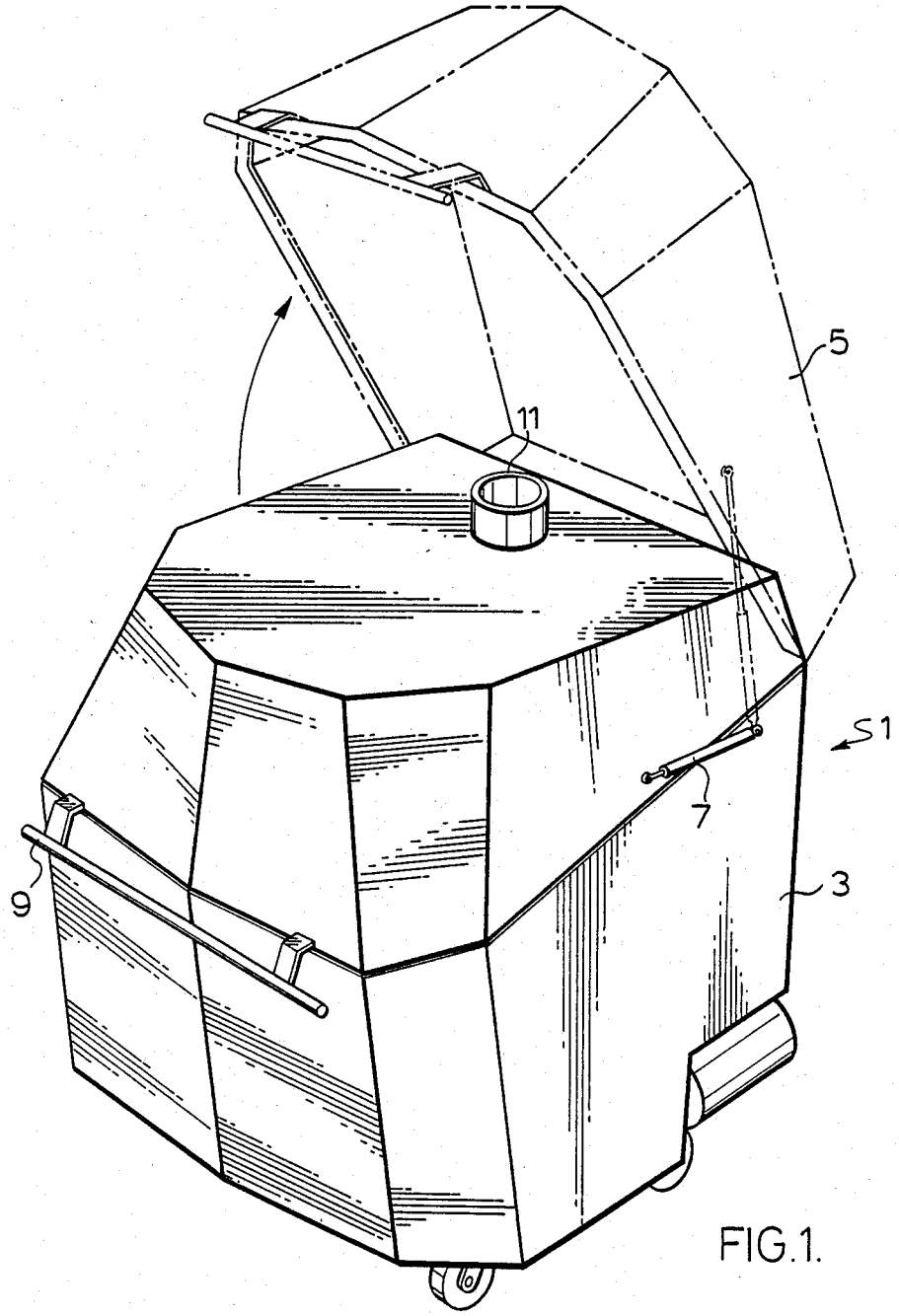
FIG. 1 is a perspective view of a manual lift industrial washer acccrding to a preferred embodiment of the present invention.

FIG. 1 shows an industrial washing machine, generally indicated at 1. This machine comprises a housing 3 having a manual lift lid 5 with a pair of lid control arms 7 to either side of the machine. Lid 5 is further provided with a bar 9 to provide grip in lifting the lid.

Figure 4:
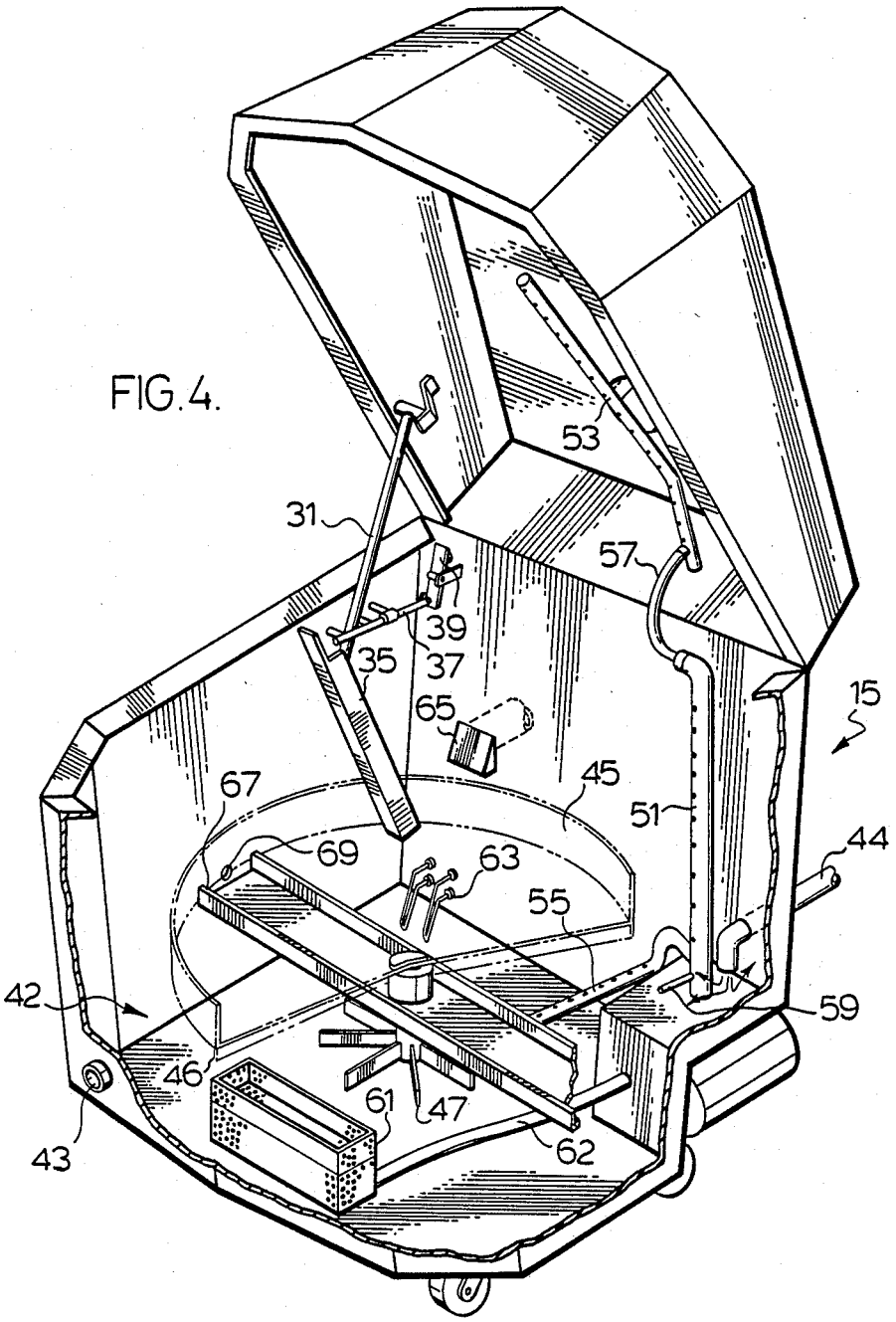
FIG. 4 is a perspective view of a power lift industrial washer, according to a further preferred embodiment of the present invention.

FIG. 4 shows an industrial washing machine, generally indicated at 15. This unit is a power lid lift machine incorporating the features additionally shown in FIGS. 5 and 6 and to be described later in detail. Other than the manual as opposed to the power lift, units 1 and 15 operate in substantially identical manners and corresponding internal parts have been icentified by the same numbers.

Figure 2:
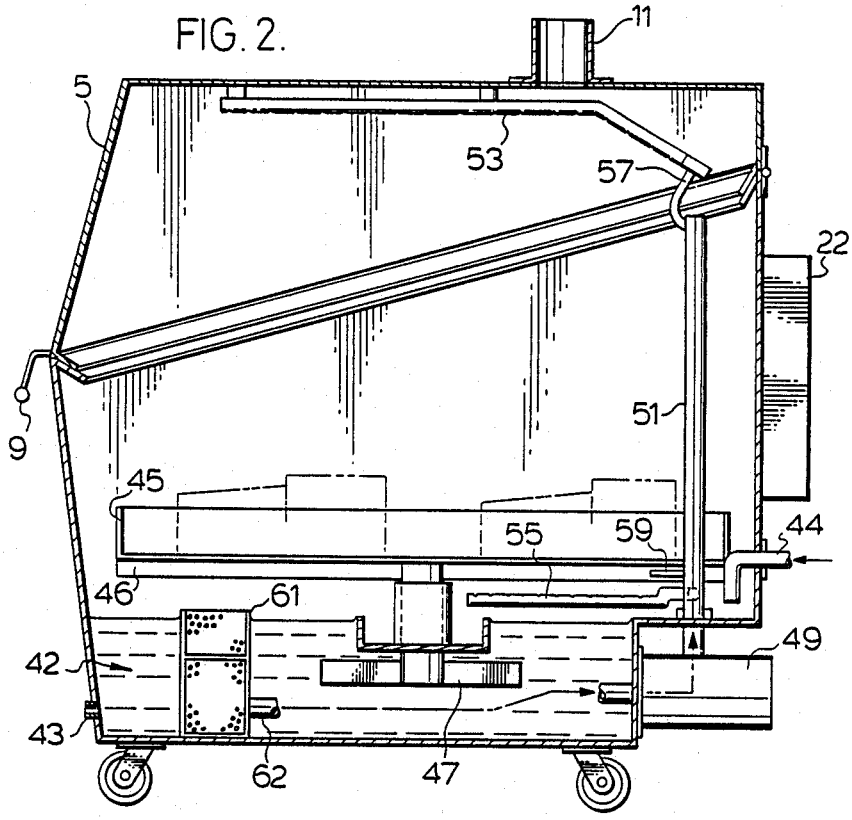
FIG. 2 is a sectional view through the industrial washer of FIG. 1.
Figure 3:
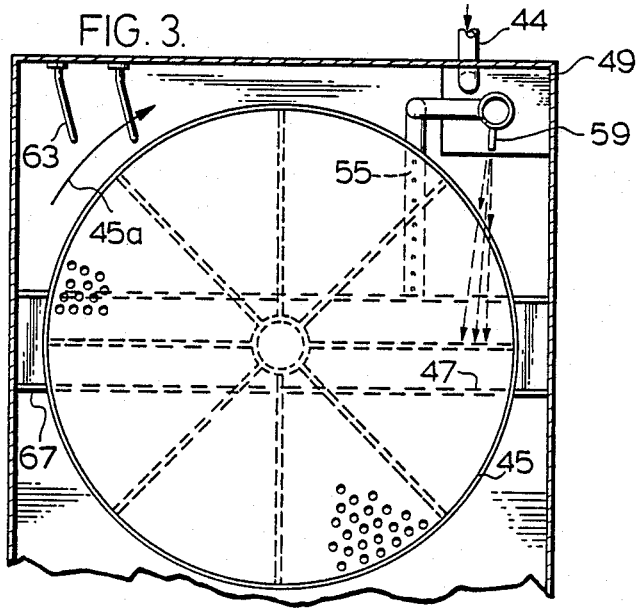
FIG. 3 is a top plan view of the operation of the internal components from the washer of FIGS. 1 and 2.

FIGS. 2 and 3 show the internal working assembly for machine 1. More specifically, the machine includes an internal liquid reservoir 42, which is filled with water through inlet 44 also used to top up the reservoir when required. Locate above the reservoir is a rotatable parts basket 45 into which different industrial parts, such as for example automotive transmissions are loaded for cleaning purposes. Extending down from and rotatably coupled to the parts basket is a paddle brake 47. Provided on the bottom of the basket itself are a plurality of vanes 46.

A water pump 49 is located to the rear of the machine for drawing water from the liquid reservoir and pumping it under pressure through a spray bar assembly directed at the cleaning basket. This spray bar assembly includes a vertical section 51 extending through a flexible coupling 57 to a horizontal section 53 secured to the inside of the lid and aimed downwardly at the parts basket. The flexible coupling allows lifting of the lid with sections 51 and 53 remaining coupled to one another. A further horizontal spray bar section 55, common to the same spray bar assembly, is provided beneath and directed upwardly at the parts basket.

A jet member or nozzle 59 offshooting from spray bar 51 provides a jet stream under pressure from pump 49 for rotating the parts basket.

Provided directly within reservoir 42 is an immersion heater 63 for heating of the cleaning liquid which is generally kept at about 160° F. Located above the liquid reservoir is a vent 65, opening through the back of the machine.

Provided to the rear outside of the machine is an electrical box 22 for housing the various different electrical components of the machine.

The first stage in operating the machine is the filling of the liquid reservoir by an outside water supply through inlet 44. The reservoir is filled to the approximate level as shown in FIG. 2. Located within the reservoir is a porous detergent or soap loader 61 connected directly with pump 49 by means of hose 62.

With the liquid reservoir appropriately filled pump 49 is turned on to draw a mixture of water and detergent from the soap loader through line 62 and force the mixed cleaning solution upwardly into the spray bar assembly. The various different sections are provided with a series of small openings which, as seen in the drawings, are directed to substantially cover the entirety of the parts basket. At the same time, the cleaning solution is forced outwardly through jet member or nozzle 59, as best shown in FIG. 3, directed at the vanes on the bottom of and rotating the parts basket. Accordingly, the same water supply is used to both provide the cleaning spray through the spray bar assembly and the rotational drive for the parts basket through the jet stream.

It is essential that the speed of the parts basket be controlled to prevent the basket from free wheeling which could otherwise damage both the machine and the parts in baskets. This control is accomplished by means of the paddle assembly 47 which effectively acts as a braking device within the liquid reservoir. To assist in the braking action jet 59 is set up to rotate the basket in the direction of arrow 45*a*, while pump 49 circulates the water through detergent loader 61 in the opposite direction, i.e. the water is circulated in a direction opposite to that in which the basket is rotated so that the paddle brake 47 is always rotating against and braked by the current in the reservoir.

In conventional automotive parts washers, a soft wash, i.e. the pressure of the spray cleaning, is considered to be about 70 lbs. per square inch with hard washes ranging anywhere from 200 to 1200 lbs. per square inch. However, operating at these high pressures is not only hard on the pump but can also cause damage to certain automotive parts and in fact cannot be used in flushing out radiators and transmission coolers where the spray pressure should not exceed 50 lbs. per square inch.

In the case of the preset invention the cleaning spray pressure is preferably at about 34 to 36 lbs. per square inch and is controlled not to exceed about 44 lbs. per square inch. The cooperation between the spray bar and the jet nozzle act as a safety guard in preventing undesirably high spray pressures. Since the jet nozzle, which is of a substantially increased bore e.g. something in the neighborhood of about 1.1 inches versus the much smaller spray bar holes at about 2.4 mm. provides an overflow relief against spray pressure increase. For example, should any of the holes in the spray bar become blocked the jet nozzle becomes the path of least resistance and picks up the greater portion of directed liquid flow which would otherwise have resulted in a correspondingly greatly increased spray pressure through the non-blocked spray bar holes.

As stated above, it is also important that the parts basket be maintained at a controlled rotational speed. Again, this is achieved by means of the paddle brake physically located in the liquid reservoir and guarding against increased basket speeds, even when there is additional flow from the jet nozzle.

From a simplicity of construction standpoint, the holes in the spray bar are nothing more than drilled jets having a relatively random pattern covering the parts basket without any specific preciseness to the individual holes. Therefore, if they wear or do become blocked, the entire bar can simply be welded and redrilled without having to actually replace the bar. This is to be compared to conventional machines where fishtail type jets are used which, if blocked or damaged, require substantially more maintenance or even replacement of the entire spray assembly.

During the cleaning sequence the parts basket is rotated and the cleaning spray is directed, as described above, from different directions to cover the parts basket and physically clean dirt and grease from the parts. This dirt and grease is then carried down intc reservoir 42 where the liquid is recirculated through the pump back to the sprayer and onto the parts. Accordingly, it is important that this recycled or recirculated cleaning solution be as free as possible of the dirt and grease which has already been cleaned from the parts. This is taken into account in the present invention by constructing the reservoir of a size relative to the suction on the pump such that the recirculation time for the water in the reservoir is a minimum of about once per minute and ranging as low as once per two minutes allowing substantial time for the dirt to simply fall or settle out of the water to the bottom of the tank before being recirculated. This is to be compared to prior art constructions having a recirculation rate of about four times per minute where there is not sufficient time for the effective self cleaning of the water through dirt fallout and resulting in relatively dirty cleaning solution being sprayed back onto the parts.

Cleaning trough 67 further assists in cleaning of the recirculated solution by providing a grease trap for the less dense oils and greases which do not fall down to the bottom of the tank. These trapped oils and greases are then drawn off from the machine through opening 69 which feeds from trough 67. The sludge and sediment which builds up at the bottom of the tank is drawn off through the bottom positioned water vent 43 which is also used as a hose connection to empty the reservoir using the cleaning solution as a cleaner for any surface on which the machine is located. Furthermore, as seen in the drawings the machine itself is mobile and can be moved around to clean where desired.

As earlier mentioned, the industrial washer of the present invention is designed with safety in mind and each of the units shown in the drawings incorporate different safety features. In particular, both machines 1 and 15 have a venting system for venting trapped steam before the machine is opened. This venting system includes the upper outlet vent 11 which is a power vent for blowing the steam from the unit and the inlet vent 65 which through pressure differential automatically provides an intake of fresh air as the steam is vented. In the preferred form of the present invention the machine is provided with a timer located in the electrical box 22 which operates an internal fan (not shown) for drawing off the steam before the lid can be opened. In other words, the lid can only be lifted after the steam has been cleared as determined by the timer which may operate for example for a period of about 45 seconds after which the lid is released from a locked position for lifting upwardly to gain access to the interior of the machine.

In the manual lift unit as shown in FIG. 1, arms 7 which have a relatively standard construction act as an assist in lifting the lid and prevent it from free falling back to the closed position.

Figure 5:
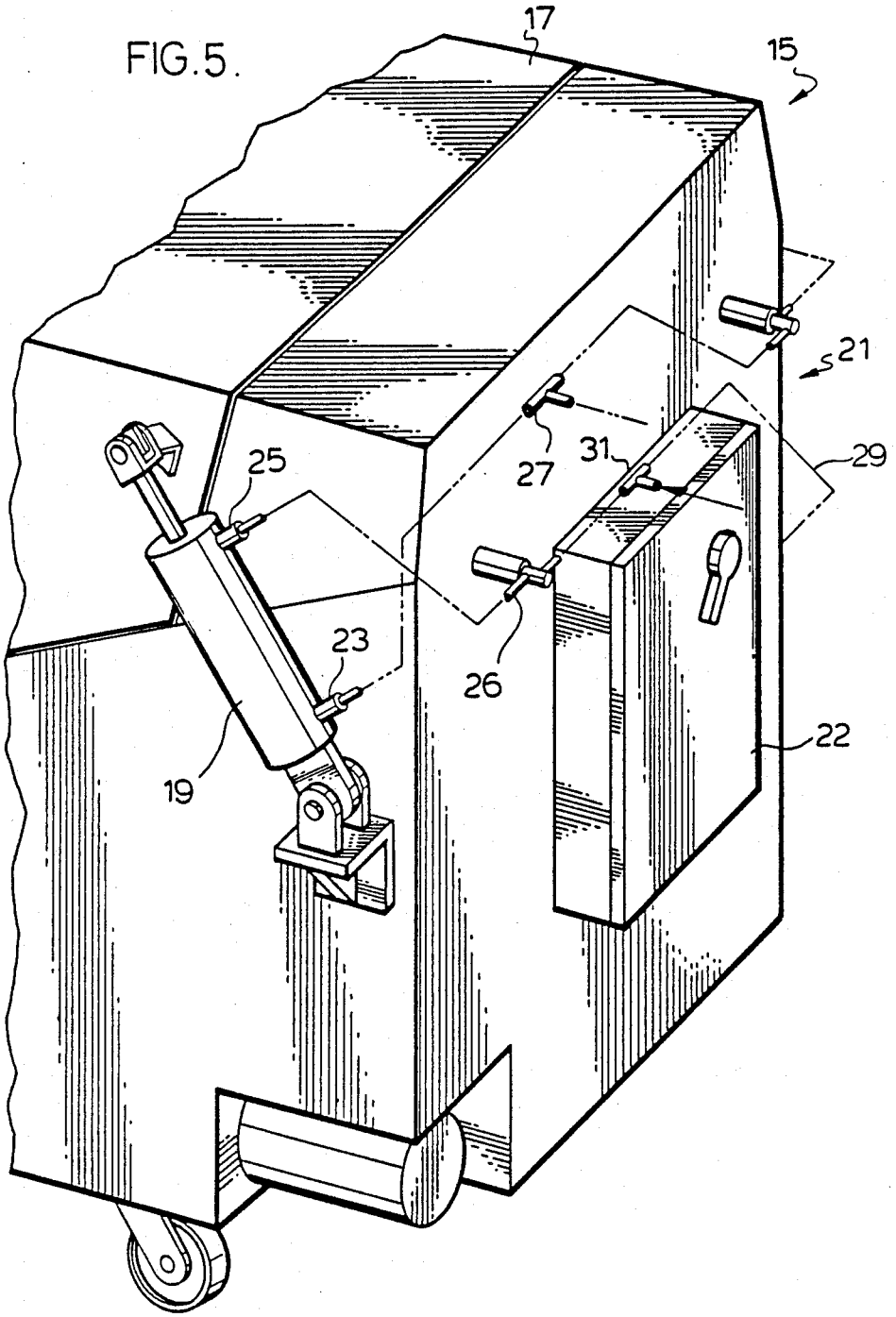
FIG. 5 is a rear perspective view of the washer of FIG. 4.
Figure 6:
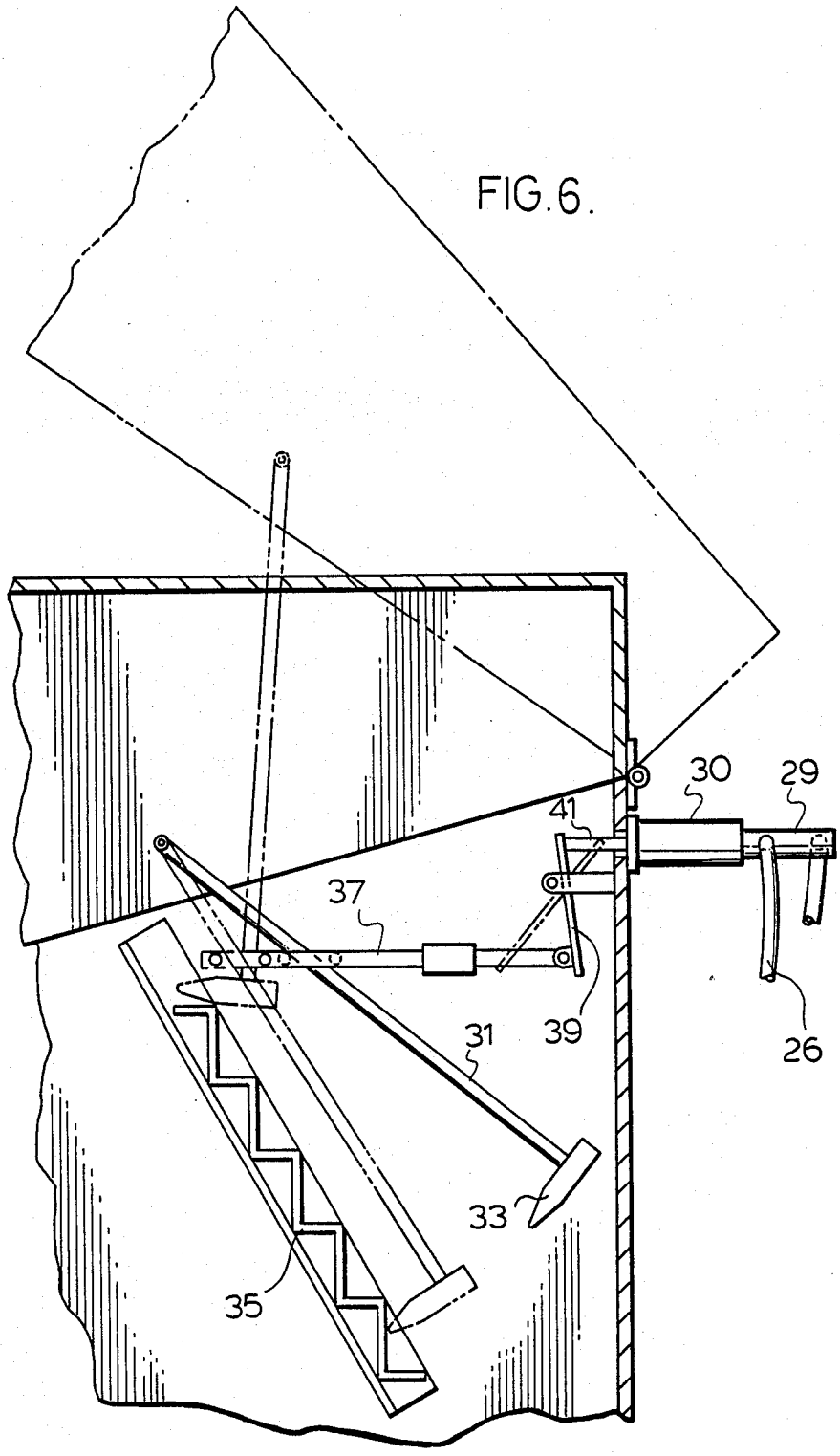
FIG. 6 is an enlarged sectionaI view of the rear region of the washer of FIG. 4 showing the lifting mechanism in detail.

In the power lift unit, shown in FIGS. 4 through 6, where like the unit in FIGS. 1 through 3 the lid opens to about 90° to allow full interior access for use with an overhead crane or the like a specific pneumatic control system including safety features is used to operate the cylinder arms 19. This pneumatic control system is operated by a standard compressor which may be included as part of the machine or as a totally separate unit. The compressor which is not shown feeds air under pressure to one of two selected input lines depending on whether the lid is being lifted or lowered. In the case of lifting the lid the air feeds to a T junction 27 which is connected to air valves 23 at the bottom of each of the cylinders 19 to either side of the machine. This incoming air pushes on and opens the cylinder arm to lift lid 17. In order to enable the movement of the piston arm air valve 25 provides a bleed off for air trapped in the cylinder.

The machine is provided internally with a ratchet assembly which operates with the lifting of the lid. This ratchet assembly comprises arm 31 having a foot 33 which travels up and down relative to ratchet step 35. Arm 31 is pivotally connected, as shown in FIG. 6, from a control arm 37 through lever plate 39 to a piston arm 41 reciprocal relative to a spring loaded cylinder 30. The spring in cylinder 30 biases piston arm 41 to a normally retracted position to cause lever plate 39 to move to the dotted line position, shown in FIG. 6, pushing on control arm 37 and forcing the foot of the ratchet arm to engage with the ratchet step. Accordingly, as the lid is lifted foot 33 simply ratchets it way upwardly along step 35. Therefore, in the event that there is any type of failure at the lift arms 19 the ratchet arm assembly with foot 33 trapped in one of the ratchet steps will prevent the lid from falling downwardly. In addition, should one of the lift arms fail there will still be an air-pressure build-up within the lift arms which would only bleed off very slowly back through air valve 23 and therefore preventing an immediate or sudden collapsing of the lift arm.

The power lift unit is further provided with an override feature in the form of a trip switch which controls the lift system to continue to operate moving the lid to a fully opened position before it can be reclosed. Therefore, in the event that the closure switch is inadvertently hit while the operator is around the unit the lid will continue to lift before moving back downwardly giving the operator ample time to clear away from the machine.

The pneumatic control system also operates in lowering the lid where the air under pressure is input through T junction 31 to air input valves 25 at each of the lift arms with valves 23 now acting as an air bleed to retract the lift cylinders. Mowever, before feeding directly to cylinders 19 through line 26 the air is passed from junction 31 to an air feed 29 at the back of cylinder 30. This air feed causes piston arm 41 to move outwardly against the spring pressure causing lever 39 to pivot to the solid line position shown in FIG. 6 and pulling on control arm 37 to disengage the ratchet assembly allowing the lowering of the lid.

The controlled air bleed through valves 23 is extremely important during the closing of the lid since this ensures that the lid will not free fall to the closed position. In the event that there is any air pressure malfunction during the closing of the lid piston arm 41 will be immediately retracted by the string mechanism in cylinder 30 to cause re-engagement of the ratchet assembly and lock the lid from moving any further downwardly.

From the above, it will be seen that the industrial washer of the present invention has been designed with an extremely safe and efficient yet low maintenance construction to eliminate both on the job injuries and any substantial shut down time. Furthermore, although various preferred embodiments of the invention have been described in detail, it will be appreciated by those skilled in the art that variations may be made without departing from the spirit of the invention or the scope of the appended claims.

The embodiments of the invention in which an exclusive property or privilege is claimed are defined as follows:

1. An industrial washing machine comprising a housing, a liquid reservoir receiving a cleaning liquid therein and a rotatable article receiving basket above said reservoir in said housing; braking means extending down from said basket into said liquid for braking rotational speed of said basket, in use; spray means susceptible to blockage for producing a plurality of cleaning sprays directed at articles in said basket; and substantially unblockable jet means directing at least one liquid stream for rotating said basket at a predetermined speed, said jet means providing an overflow relief, if required, from blockage of a portion of said spray means, and increasing accordingly in flow rate when providing such relief, said braking means maintaining substantially unchanged said predetermined speed of said basket with an increased flow rate from said jet means.

2. An industrial washing machine as claimed in claim 1, wherein said spray means operates at a preset spray pressure and wherein said jet means, by providing said overflow relief thus limits a substantial increase in said preset spray pressure on the occurence of said blockage.

3. An industrial washing machine as claimed in claim 2, wherein said spray means is a spray bar with a series of orifices provided therealong and wherein said jet meas comprises a substantially open ended conduit offshooting in parallel flow relation from said spray bar, said machine including a pump located adjacent said reservoir for pumping the liquid through said spray bar and in parallel flow relation through said substantially open ended conduit to rotate said basket.

4. An industrial washing machine as claimed in claim 3, wherein portions of said spray bar extend beneath, to the side of and above said basket.

5. An industrial washing machine as claimed in claim 1, wherein said basket includes a plurality of vanes positioned to receive the liquid stream from said jet means for rotating said basket.

6. An industrial washing machine as claimed in claim 1, wherein said braking means comprises a paddle assembly extending down from said basket into said liquid reservoir providing continuous braking of said basket when said machine is operating.

7. An industrial washing machine as claimed in claim 6, including a pump connected with said reservoir, in use for pumping liquid through said spray means and said jet means, said pump having an inlet connection within said reservoir in laterally offset relation setting up a circulation current in said reservoir; and said jet means directing the liquid stream onto and rotating said basket in a direction opposite to that of such circulation current wherein said circulation current is effective in assisting braking of said basket.

8. An industrial washing machine as claimed in claim 7, including an open topped porous filter detergent loader located in said reservoir and having said pump inlet connection connected to one end thereof.

9. An industrial washing machine as claimed in claim 1, including a clean-off trough having an extended edge portion to form a weir adjacent a normal surface level of said cleaning liquid positioned to trap and carry-off greases and oils cleaned from articles in said basket and otherwise floating on the liquid in said reservoir.

10. An industrial washing machine as claimed in claim 1, including electrical resistance heating means for heating of said cleaning liquid in said reservoir.

11. An industrial washing machine as claimed in claim 1, including a bottom located sludge drain in said reservoir.

12. An industrial washing machine as claimed in claim 11, said sludge drain including a flush hose fitting for flushing said cleaning liquid from said liquid reservoir.

13. An industrial washing machine as claimed in claim 1, including a hinged lid for opening and closing said housing.

14. An industrial washing machine as claimed in claim 13, wherein said hinged lid opens about 90° from a closed to an open position allowing full access to said machine.

15. An industrial washing machine as claimed in claim 14, including cylinder and piston arm means connecting said lid to said housing for assisted opening and closing of said lid.

16. An industrial washing machine as claimed in claim 15, including a pneumatic control system for operating said cylinder and piston arm means to lift and lower said lid.

17. An industrial washing machine as claimed in claim 16, including safety control means causing said lid when lifted by said cylinder and piston means to move to a fully opened position before being lowerable to a closed position.

18. An industrial washing machine as claimed in claim 16, wherein said pneumatic control system comprises an upper and a lower air passage into each piston arm, the lower air passage, in opening operation being actively operated and the upper air passage provided a controlled air bleed for opening the lid; and the upper air passage being actively operated and the lower air passage providing a controlled air bleed for lowering the lid.

19. An industrial washing machine as claimed in claim 18, including a ratchet arm normally biased to a ratchet engaging position to prevent closing of said lid; and including air actuated actuator means to move said ratchet arm away from such ratchet engaging position by admission of air pressure from said pneumatic control system thereto in conjunction with active operation of said upper air passage, to allow closing of said lid.

20. An industrial washing machine as claimed in claim 16, having a power vent for venting steam built up internally of said machine while in operation.

21. An industrial washing machine as claimed in claim 20, including timing means for locking said machine closed until the steam has been vented.

22. An industrial washing machine as claimed in claim 1, wherein said cleaning liquid is circulated from said reservoir to said spray means and said jet means and back to said liquid reservoir at a maximum recirculation rate of about once per minute.

23. An industrial washing machine as claimed in claim 1, having a recirculation rate of said cleaning liquid of between once per minute and once per two minutes.

* * * * *